US006890220B2

(12) United States Patent
Wang

(10) Patent No.: US 6,890,220 B2
(45) Date of Patent: May 10, 2005

(54) ELECTRICAL CONNECTOR ASSEMBLY

(75) Inventor: ZhenSheng Wang, Kunsan (CN)

(73) Assignee: Hon Hai Precision Inc. Co., LTD, Taipei Hsien (TW)

( * ) Notice: Subject to any disclaimer, the term of this patent is extended or adjusted under 35 U.S.C. 154(b) by 0 days.

(21) Appl. No.: 10/928,449

(22) Filed: Aug. 27, 2004

(65) Prior Publication Data

US 2005/0048844 A1 Mar. 3, 2005

(30) Foreign Application Priority Data

Aug. 27, 2003 (CN) ..... 03278205 U

(51) Int. Cl.[7] ..... H01R 13/64
(52) U.S. Cl. ..... 439/680; 439/677
(58) Field of Search ..... 439/680, 633, 439/677, 674

(56) References Cited

U.S. PATENT DOCUMENTS 5,380,217 A 1/1995 Yagi et al.
6,135,822 A * 10/2000 Hwang ..... 439/680
6,159,054 A * 12/2000 Ko ..... 439/680
6,165,024 A * 12/2000 Ko ..... 439/680
6,183,287 B1 2/2001 Po
6,302,744 B1 * 10/2001 Nomura ..... 439/680
6,312,294 B1 11/2001 Lai
6,350,159 B1 2/2002 Wu

* cited by examiner

*Primary Examiner*—Tho D. Ta
(74) *Attorney, Agent, or Firm*—Wei Te Chung

(57) ABSTRACT

An electrical connector assembly (100) in accordance with the present invention, comprises a receptacle connector (20) and plug connector (10). The receptacle connector comprises an insulative housing (21) and a plurality of first terminals (24) received in the housing. The housing comprises a base portion (211) and a mating portion (212) extending from the base portion (211). The mating portion (212) comprises a top wall, a bottom wall and a pair of side walls connecting with the top and the bottom walls and defines a tongue (26) therein. A lateral side of tongue connects with one of the side walls, and another side of the tongue is spaced with the other side wall where a recess (262) is formed. The plug connector comprises an insulative housing (11) and a plurality of second terminals (14) received in the insulative housing. The housing comprises a base portion (111) and a pair of parallel tongues (113) extending from the base portion. A rib (114) is formed to connects the two tongues. The rib is received in the recess when the two connectors engaged with each other to avoid mis-mating.

12 Claims, 8 Drawing Sheets

ELECTRICAL CONNECTOR ASSEMBLY

BACKGROUND OF THE INVENTION

1. Field of the Invention

The present invention generally relates to an electrical connector assembly, and particularly to an electrical connector assembly having an anti-mismating structure.

2. Description of Related Arts

It is well known an electrical connector assembly normally comprises a plug connector and a receptacle connector. A D-shaped interface is always employed to prevent mismating between the plug connector and the receptacle connector. Such connector is disclosed in U.S. Pat. No. 6,312,294. Another choice for anti-mismatch is to form a pair of matchable rib and slot around the interface of the plug and the receptacle, respectively. Such structure can be found in U.S. Pat. No. 6,350,159. With the electrical connectors becoming more and more smaller, the overall dimension of the D-shaped interface is decreased. Obviously, mismating between the plug and receptacle become easy compared with traditional connector having large D-shaped interface. Simultaneously, defining a pair of rib and slot around the interface of the connector will increase the size of the connector, which is not fit for the today's requirement.

Hence, it is desirable to have an improved connector assembly to overcome the above-mentioned disadvantages of the related art.

BRIEF SUMMARY OF THE INVENTION

Accordingly, it is an object of the present invention to provide an electrical connector assembly with an anti-mismating structure.

In order to achieve the above-mentioned object, an electrical connector assembly in accordance with the present invention, comprises a receptacle connector and plug connector. The receptacle connector comprises an insulative housing and a plurality of first terminals received in the housing. The housing comprises a base portion and a mating portion extending from the base portion. The mating portion comprises a top wall, a bottom wall and a pair of side walls connecting with the top and the bottom walls and defines a tongue therein. A lateral side of tongue connects with one of the side walls, and another side of the tongue is spaced with the other side wall where a recess is formed. The plug connector comprises an insulative housing and a plurality of second terminals received in the insulative housing. The housing comprises a base portion and a pair of parallel tongues extending from the base portion. A rib is formed to connects the two tongues. The rib is received in the recess when the two connectors engaged with each other to avoid mis-mating.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
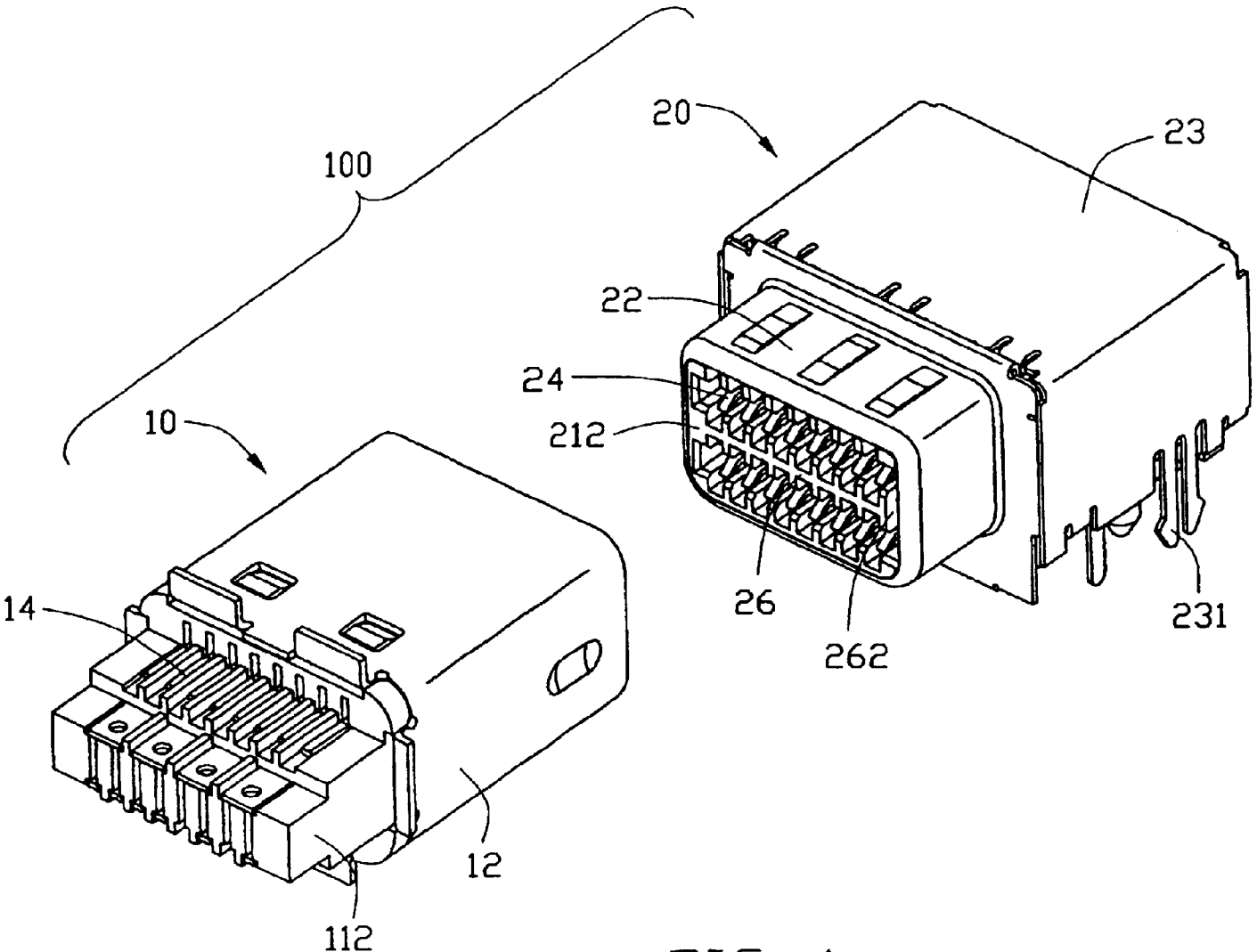
FIG. 1 is a perspective view of an electrical connector assembly in accordance with the present invention.

Reference will now be made to the drawing figures to describe the present invention in detail.

Figure 2:
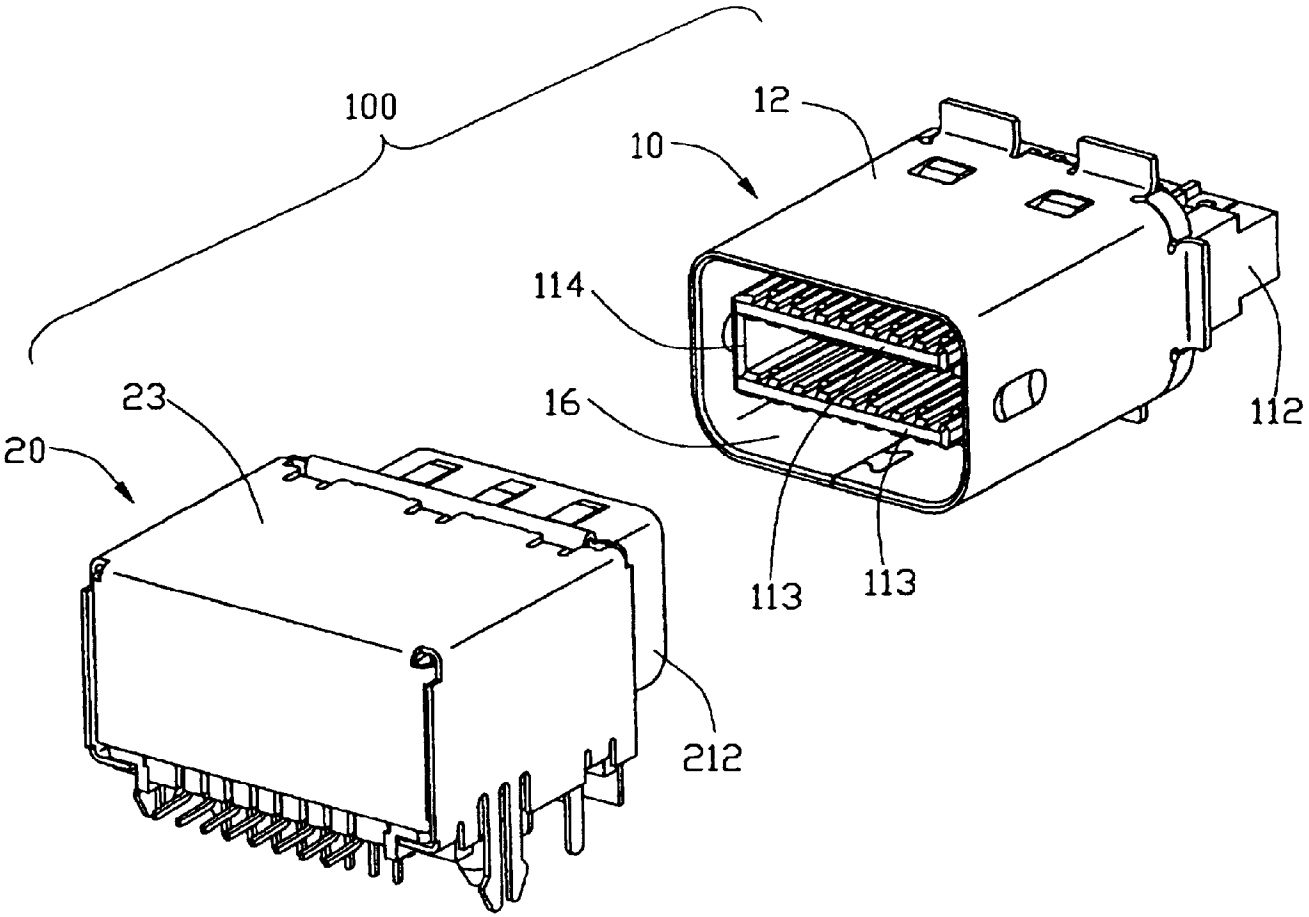
FIG. 2 is another perspective view of the electrical connector assembly.

With reference to FIGS. 1–2, an electrical connector assembly 100 in accordance with the present invention comprises a plug connector 10 and a receptacle connector 20 corresponding to the plug connector 10.

Figure 3:
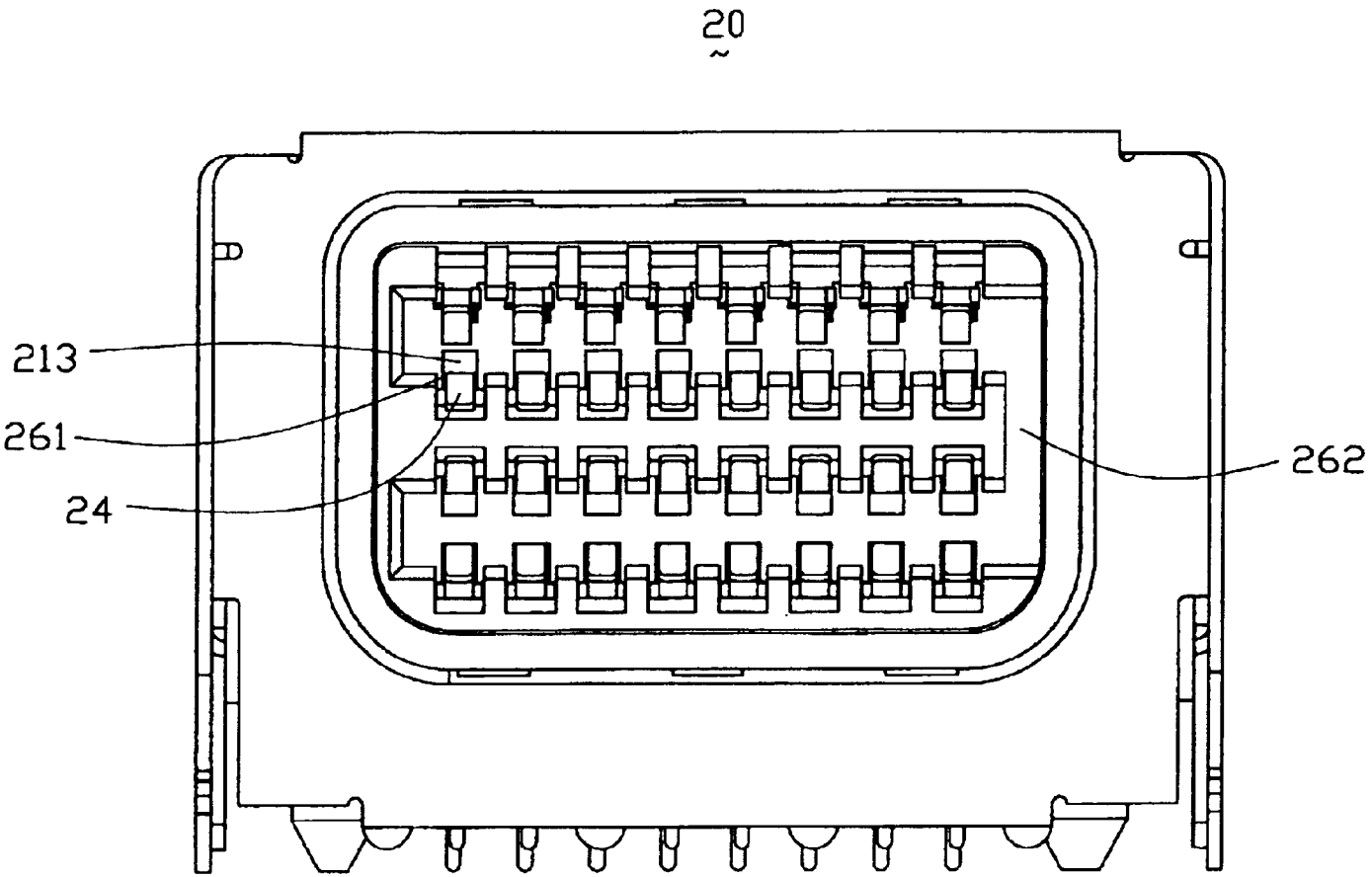
FIG. 3 is a front view of a receptacle connector.
Figure 5:
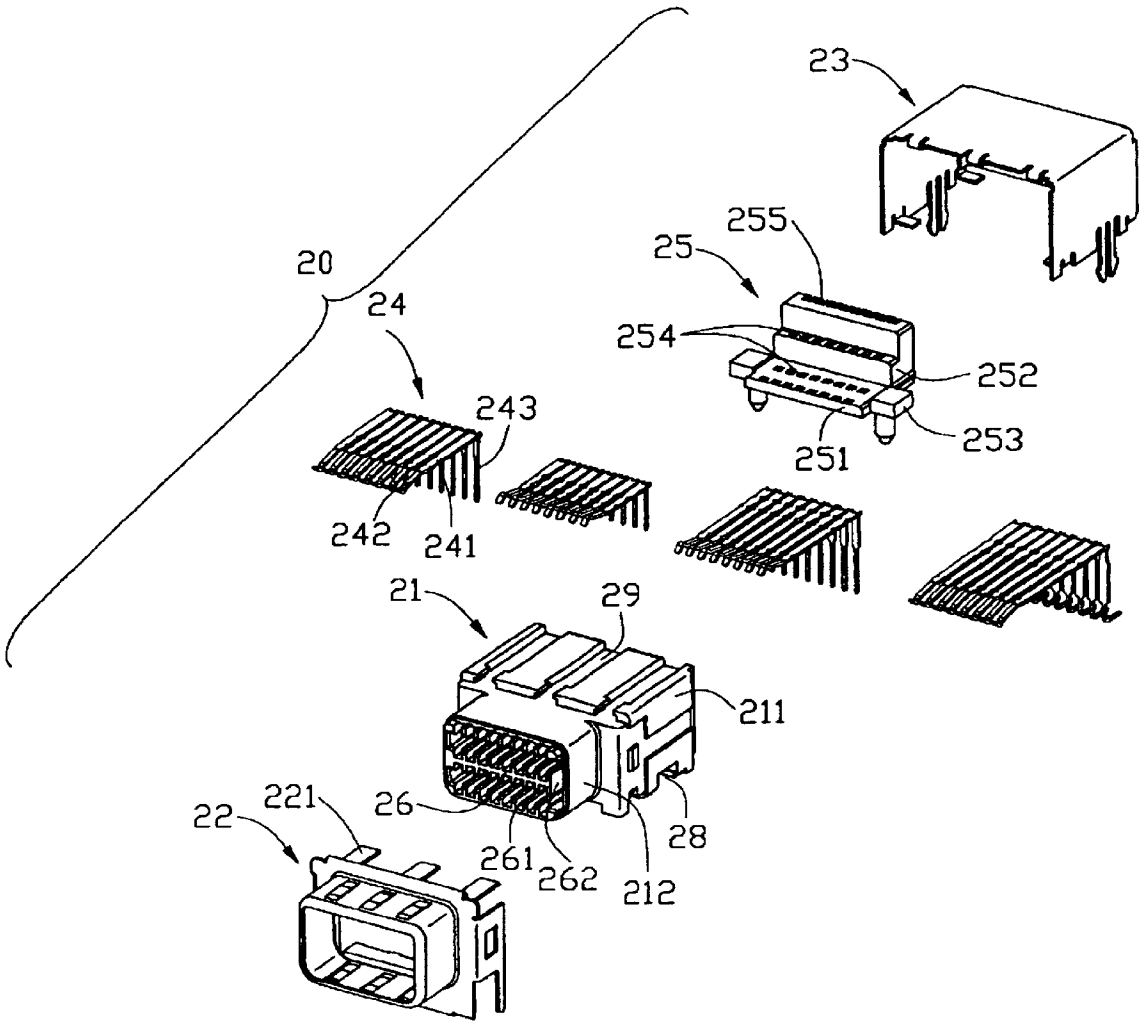
FIG. 5 is an exploded, perspective view of the receptacle connector.
Figure 6:
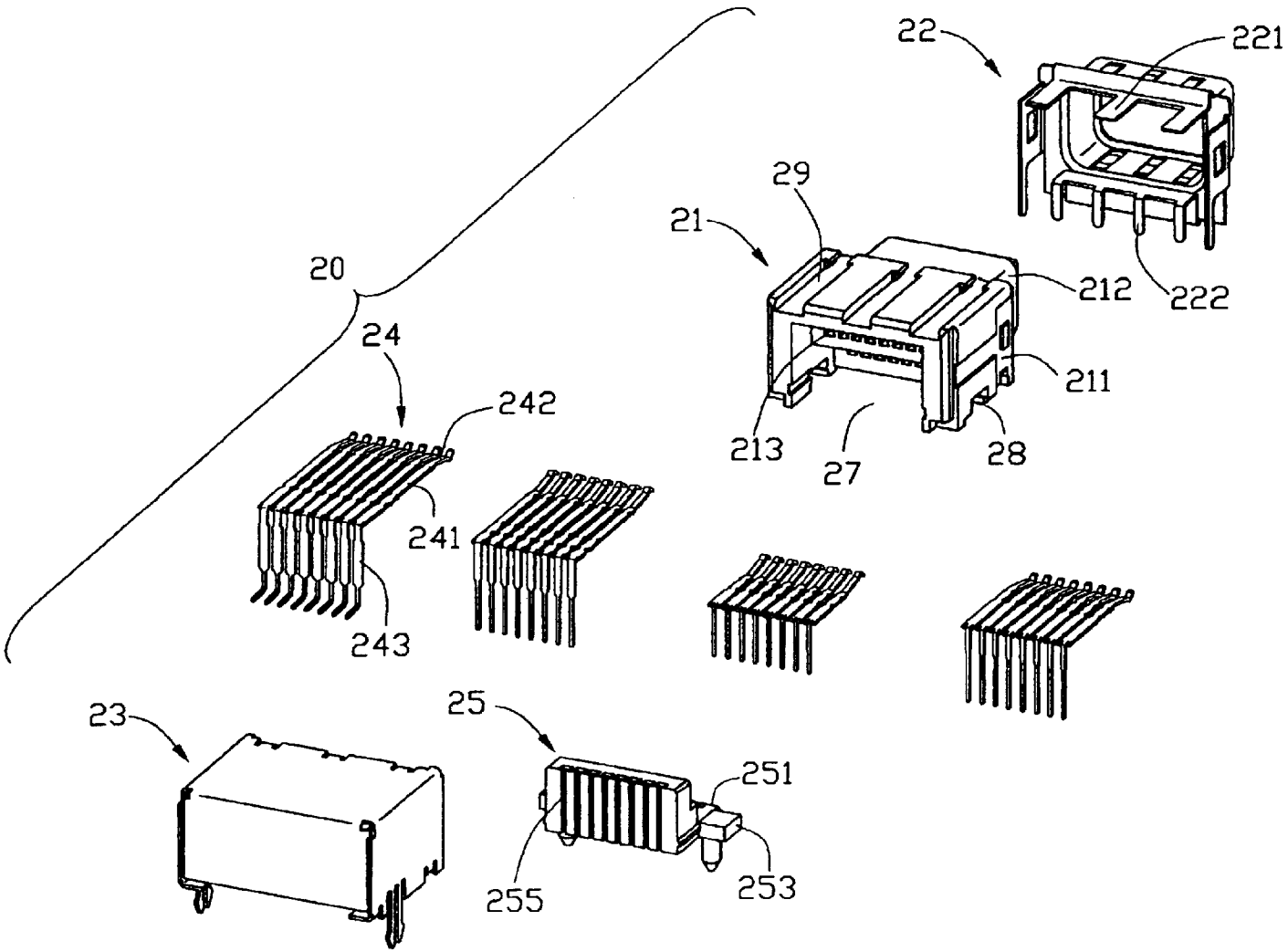
FIG. 6 is an exploded, perspective view of the receptacle connector.

With reference to the FIG. 3, FIG. 5 and FIG. 6, the receptacle connector 20 comprises an insulative housing 21, a plurality of first terminals 24 received in the insulative housing 21, a spacer 25 assembled at the rear of the insulative housing 21 and a shell enclosed the insulative housing 21. The insulative housing 21 comprises a base portion 211, a mating portion 212 extending forwardly from the base portion 211. A plurality of passageways 213 extending through the base portion 211 along a front-to-rear direction and are arranged in four parallel rows. The mating portion 212 defines an upper wall, a lower wall and a pair of side walls (not labeled) connecting with the upper and lower walls. The mating portion 212 has a tongue 26 extending between the two side walls and parallel to the upper and lower walls. A plurality of receiving slots 261 are respectively defined on a bottom face of the upper wall, a top face of the lower wall and two opposite faces of the tongue 26 which communicate with corresponding passageways 213. A lateral side of the tongue 26 integrally connects with one of the side walls of the mating portion 212, and another lateral side of the tongue 26 is spaced from another side wall of the mating portion 212 where a recess 262 is formed therebetween. The rear of the base portion 211 defines a first receiving space 27 for receiving the spacer 25. The two side walls of the base portion 211 define a gap 28 at a bottom. The top wall of the base portion 211 has a plurality of retaining slots 29. The spacer 25 is formed with insulative material and comprising a base 251, a pair ladder portion 252 extending upwardly from the base 251 and a pair of projections 253 extending outwardly from opposite ends of the base 251, respectively. The base 251 defines a plurality of holes 254 and the ladder portion 252 defines a plurality of positioning slits 255 at rear face thereof. The shell includes a first shell 22 enclosing the mating portion 212 and a second shell 23 enclosing the base portion 211. The first shell 22 defines a plurality of retaining plates 221 corresponding to the retaining slots 29 on the insulative housing 21 and a plurality of grounding plates 222 (FIG. 6) on the lower end. Each first terminal 24 comprises a contacting portion 242, an intermediate portion 241 extending rearwardly from the contacting portion 242 and a soldering portion 243 extending downwardly from the intermediate portion 241. The first terminals 24 are arranged in four rows.

In assembly, the intermediate portion 241 of the first terminal 24 is received in the corresponding passageway 213. The contacting portion 242 extends into the receiving slot 261 of the mating portion 212, and the soldering portion 243 extends beyond the bottom face of the insulative housing 21. The spacer 25 is assembled into the first receiving space 27 with the projection 253 being received in the corresponding gap 28. Three rows of the first terminals 24 have the soldering portions 243 inserting into the holes 254 of the spacer 25, and the last row of the first terminals 24 have the soldering portions 243 inserting into the positioning slits 255 of the spacer 25. The first shell 22 is assembled to the mating portion 212 with its retaining plates 221 received in the retaining slots 29 of the insulative housing 21. The second shell 23 encloses the base portion and the spacer 25.

Figure 4:
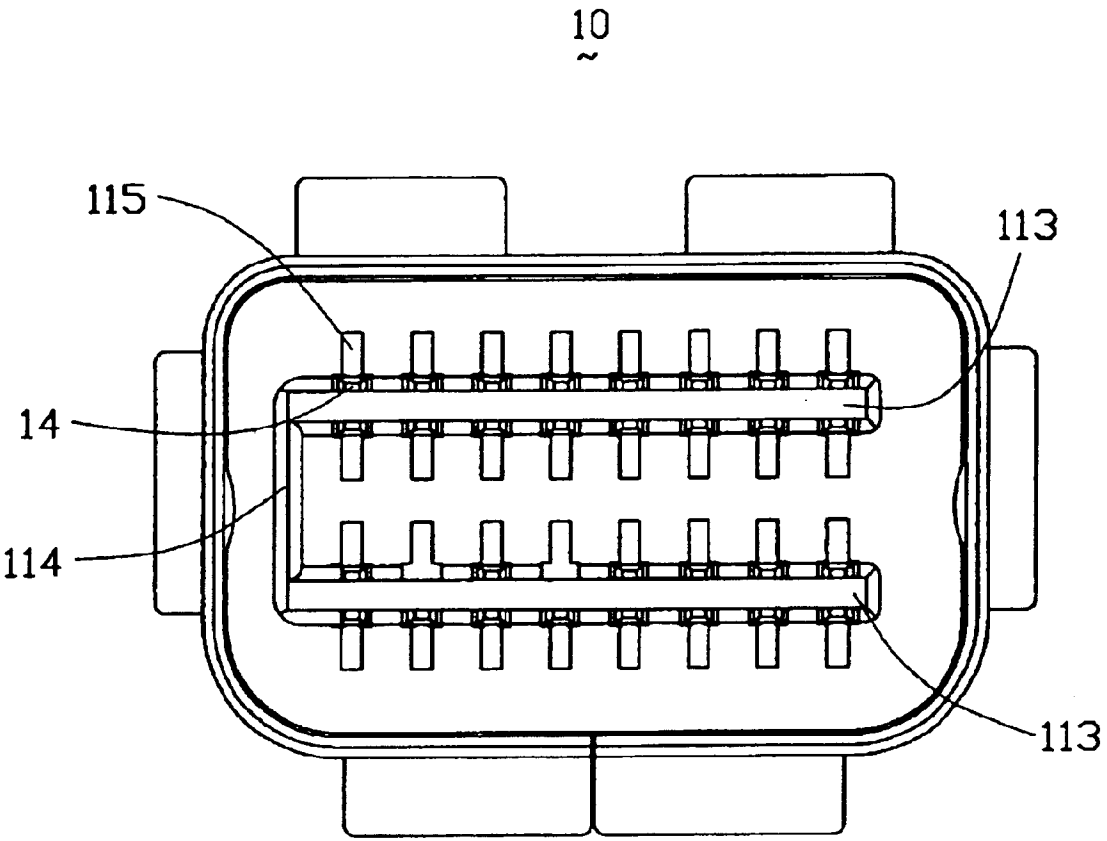
FIG. 4 is a front view of a plug connector.
Figure 7:
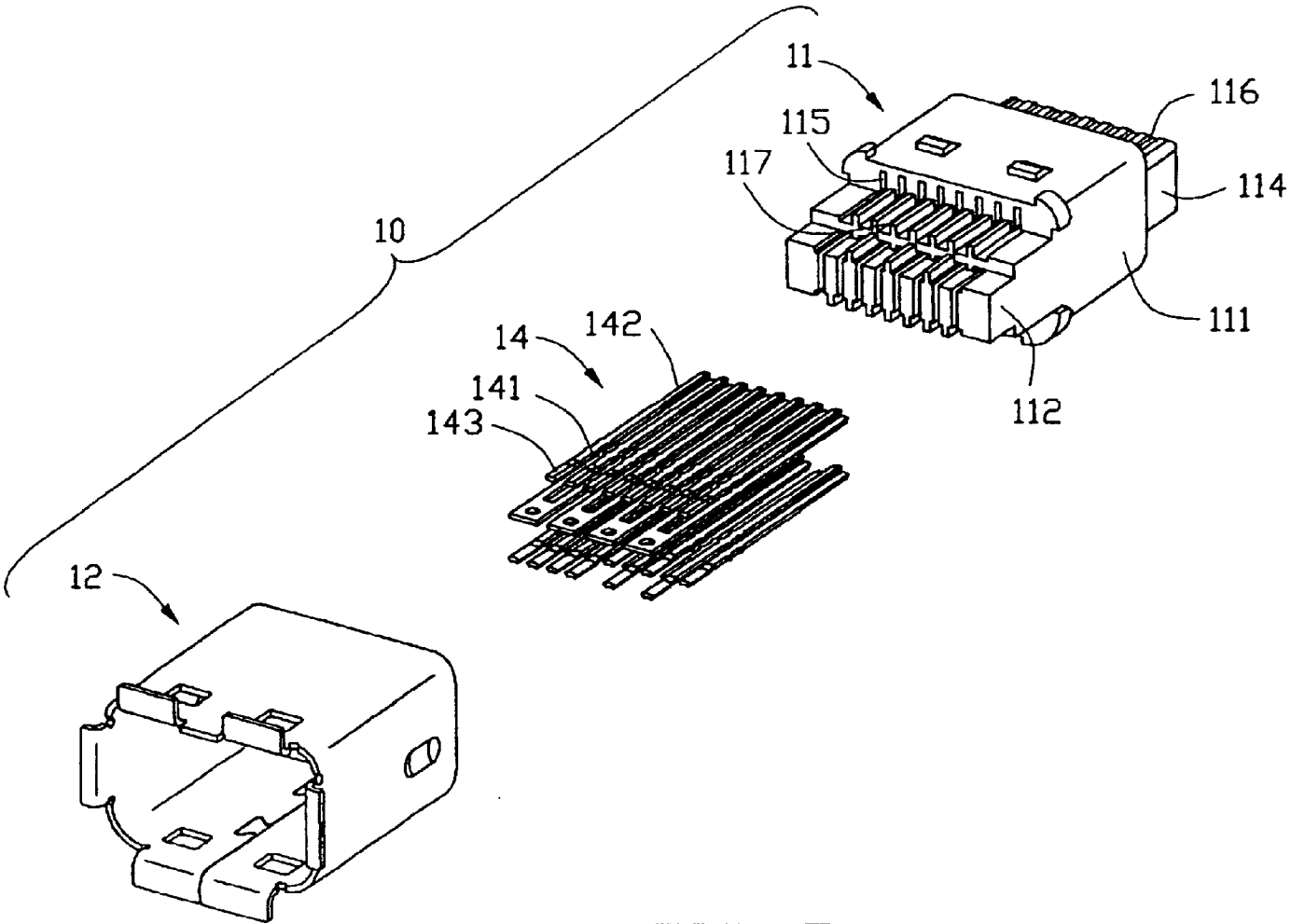
FIG. 7 is another exploded, perspective view of the plug connector shown in FIG. 5.
Figure 8:
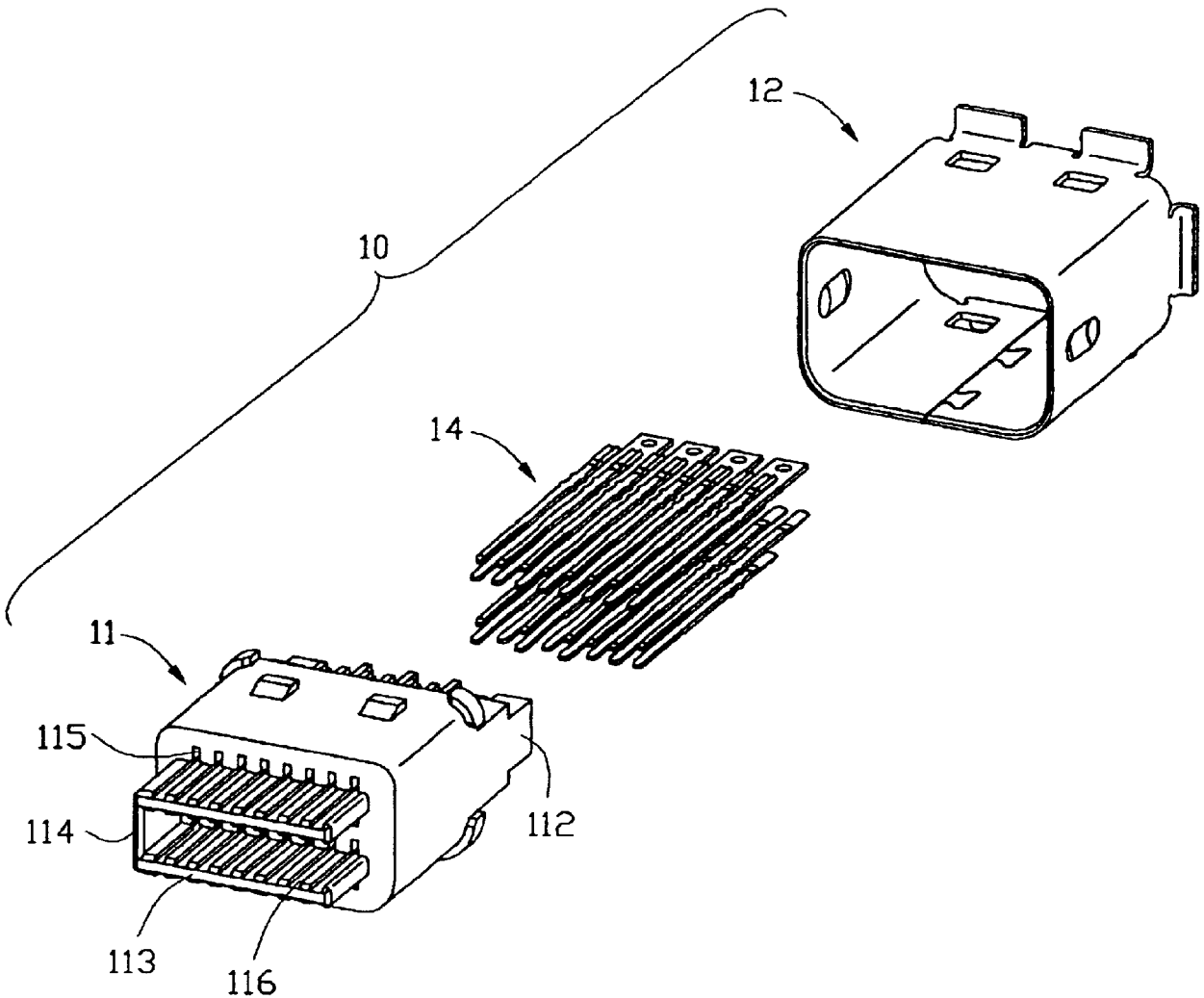
FIG. 8 is another exploded, perspective view of the plug connector shown in FIG. 6.

With reference to the FIG. 4, FIG. 7 and FIG. 8, the plug connector 10 comprises an insulative housing 11, a plurality of second terminals 14 received in the insulative housing 11 and a third shell 12 enclosing the insulative housing 11. The insulative housing 11 includes a base portion 111, a pair of parallel tongues 113 extending forwardly from the base portion 111 and a rear portion 112 extending from the base portion 111. A rib 114 is formed to connect two lateral side edges of the tongues 1113, which is positioned corresponding to the recess 262 of the receptacle connector 20. The base portion 111 defines a plurality of passageways 115 extending therethrough and arranged in four rows. A top and a bottom faces of each tongue 113 define a plurality of receiving slots 116 thereon corresponding to the passageways 115. Simultaneously, the rear portion 112 defines four receiving slits 117 corresponding to the passageways 115 of the base portion 111. Each second terminal 14 comprises a contacting portion 142 exposed in the receiving slots 116, an intermediate portion 141 extending from the contacting portion 142 retained in the passageways 1115 and a soldering portion 143 extending rearwardly from the intermediate portion 141 and positioned on the rear portions 112.

In assembly, the second terminals 14 are positioned in the housing 11. The third shell 12 encloses the base portion 111 and the tongues 113, and defines a second receiving space 16 for receiving the mating portion 212 of the corresponding receptacle connector 20.

In application, the plug connector 10 is inserted into the receptacle connector 20 with the mating portion 212 being received in the second receiving space 16 of the plug connector 10. The rib 114 of the plug connector 10 extends into the recess 262 of the receptacle connector 20. Obviously, the rib 114 and the recess 262 protect the two connectors from mis-mating in spite of the small dimensions the two connectors.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector assembly comprising:

a first connector comprising an insulative housing and a plurality of first terminals received in the insulative housing, the insulative housing comprising a base portion and a mating portion extending from the base portion, the mating portion comprising a top wall, a bottom wall, a pair of side walls and a tongue extending between the side walls and parallel to the top and the bottom walls, the housing defining a recess between a lateral side of the tongue and one of the two side walls; and a second connector comprising an insulative housing and a plurality of second terminals received in the insulative housing, the insulative housing comprising a base portion and a pair of parallel tongues extending from the base portion, the housing defining a rib connecting the pair of tongues;

wherein the rib of the second connector is received in the recess of the first connector when the two connectors engage with each other.

2. The electrical connector assembly as described in claim 1, wherein the shell of the first connector comprises a first shell and a second shell, the first shell encloses the mating portion of the insulative housing, the second shell encloses the base portion of the insulative housing.

3. The electrical connector assembly as described in claim 1, wherein the second connector comprises a third shell, the third shell encloses the base portion of the second connector.

4. The electrical connector assembly as described in claim 1, wherein the base portion of the first connector comprises a plurality of passageways extending therethrough and arranged in four rows, a bottom face of the upper face, a top face of the lower wall of the mating portion of the first connector and two opposite faces of the tongue, respectively, defining a plurality of receiving slots communicating with the corresponding passageways.

5. The electrical connector assembly as described in claim 4, wherein each first terminal comprises a contacting portion, an intermediate portion extending from the contacting portion and a soldering portion extending downwardly from the intermediate portion.

6. The electrical connector assembly as described in claim 5, wherein the intermediate portion of the first terminal is received in the passageways of the first connector and the contacting portion extending into the receiving slots of the first connector, the soldering portion extending beyond the insulative housing of the first connector.

7. The electrical connector assembly as described in claim 6, wherein the first connector comprises a spacer assembled on the rear thereof, and wherein the spacer comprises a base, a ladder portion extending from the base and a pair of projections extending oppositely from opposite ends of the base, the base defines a plurality of holes extending therethrough, and the ladder portion defines a plurality of positioning slits on the back thereof.

8. The electrical connector assembly as described in claim 1, wherein each second terminal comprises a contacting portion, a intermediate portion extending from the contacting portion and a soldering portion extending from the intermediate portion.

9. The electrical connector assembly as described in claim 8, wherein the base portion of the plug connector defines a plurality of passageways extending therethrough, and wherein top and bottom faces of each tongue define a plurality of receiving slots thereon communicating with corresponding passageways, the intermediate portion of the second terminal being received in the passageways, and the contacting portion extending into the receiving slot.

10. An electrical connector assembly comprising:

a first connector comprising an insulative housing and a plurality of first terminals received in the insulative housing, the insulative housing comprising a base portion and a mating portion extending from the base portion, the mating portion being of a lying U-shaped configuration and enclosed in a first outer shell; and a second connector comprising an insulative housing and a plurality of second terminals received in the insulative housing, the insulative housing comprising a base portion and a mating section extending from the base portion and enclosed in the second shell, said mating section defining therein a lying U-shaped recess therein; wherein when the first and second connectors are mated with each other, the lying U-shaped configuration is received in the lying U-shaped under a condition that the second shell is enclosed in the first shell.

11. The electrical connector assembly as described in claim 10, wherein the first and second terminals are mated in four rows.

12. The electrical connector assembly as described in claim 10, wherein both said first shell and said second shell are rectangular.

* * * * *